US009415559B2

(12) United States Patent
Murray

(10) Patent No.: US 9,415,559 B2
(45) Date of Patent: Aug. 16, 2016

(54) FLEXIBLE POUCH WITH INNER WALL INDICIA

(75) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 155 days.

(21) Appl. No.: 13/548,938

(22) Filed: Jul. 13, 2012

(65) Prior Publication Data

US 2013/0015091 A1 Jan. 17, 2013

Related U.S. Application Data

(60) Provisional application No. 61/507,299, filed on Jul. 13, 2011.

(51) Int. Cl.

| | |
|---|---|
| ***B65D 85/00*** | (2006.01) |
| ***B31B 1/14*** | (2006.01) |
| ***B31B 1/00*** | (2006.01) |

(52) U.S. Cl.

CPC ..... *B31B 1/00* (2013.01); *B31B 2221/05* (2013.01); *B31B 2221/107* (2013.01); *B31B 2221/25* (2013.01); *B65D 2203/00* (2013.01); *B65D 2231/022* (2013.01)

(58) Field of Classification Search

CPC .... B65D 23/085; B65D 33/004; B65D 75/52; B65D 2203/00; B65D 75/008; B65D 2231/022; G09F 19/16; B31B 1/00; B31B 2221/05; B31B 2221/0107; B31B 2221/25

USPC ..... 206/459.5; 383/113, 104–106, 109, 383/116; 40/310, 312

See application file for complete search history.

(56) References Cited

U.S. PATENT DOCUMENTS

| | | | | |
|---|---|---|---|---|
| 2,305,890 | A * | 12/1942 | Moore | 40/310 |
| 5,758,440 | A * | 6/1998 | Yudin | 40/310 |
| 6,199,601 | B1 | 3/2001 | Laudenberg | |
| 6,265,038 | B1 * | 7/2001 | Frisk | 383/104 |
| 7,703,226 | B2 * | 4/2010 | Schnuckle | 40/310 |
| 2006/0027478 | A1 * | 2/2006 | Kaufman et al. | 206/459.5 |
| 2007/0104396 | A1 * | 5/2007 | Paulin | 383/106 |
| 2008/0247682 | A1 * | 10/2008 | Murray | 383/104 |
| 2008/0276645 | A1 | 11/2008 | Murray | |
| 2009/0028470 | A1 | 1/2009 | Murray | |
| 2009/0056281 | A1 | 3/2009 | Murray | |
| 2010/0170591 | A1 | 7/2010 | Murray | |
| 2010/0281822 | A1 | 11/2010 | Murray | |
| 2011/0061222 | A1 | 3/2011 | Murray | |

(Continued)

FOREIGN PATENT DOCUMENTS

| | | | |
|---|---|---|---|
| WO | 2011032162 | A2 | 3/2011 |
| WO | 2011156575 | A2 | 12/2011 |

*Primary Examiner* — Chun Cheung
(74) *Attorney, Agent, or Firm* — Dinsmore & Shohl LLP

(57) ABSTRACT

A pouch for holding fluids is provided. The pouch includes a pouch body having a front panel and a back panel. The front panel is formed of a transparent material and includes a second indicia visible from the front of the pouch. The back panel includes a third indicia visible from the back of the pouch. The back panel includes a first indicia disposed one of the layers of the back panel and configured to be visible when the pouch is viewed from the front so as to block out the third indicia from view. A method of manufacturing a pouch is also provided. The method is directed towards facilitating the alignment of a graphical image on one side of the back panel with a graphical image on another side of the back panels in instances where the back panel is formed of multiple layers.

6 Claims, 7 Drawing Sheets

(56) References Cited

U.S. PATENT DOCUMENTS

| | | | | |
|---|---|---|---|---|
| 2011/0108572 | A1 | 5/2011 | Murray | |
| 2011/0218088 | A1 | 9/2011 | Murray | |
| 2011/0308977 | A1* | 12/2011 | DiLiberto et al. | 206/222 |
| 2012/0008884 | A1 | 1/2012 | Murray | |
| 2012/0210675 | A1 | 8/2012 | Murray | |
| 2012/0289389 | A1 | 11/2012 | Murray | |
| 2012/0289391 | A1 | 11/2012 | Murray | |
| 2013/0001252 | A1 | 1/2013 | Murray | |
| 2013/0015091 | A1 | 1/2013 | Murray | |
| 2013/0016925 | A1 | 1/2013 | Murray | |

* cited by examiner

Method for Manufacturing a Pouch

FLEXIBLE POUCH WITH INNER WALL INDICIA

CROSS-REFERENCE TO RELATED APPLICATIONS

This Application claims the benefit of U.S. Provisional Application 61/507,299 filed on Jul. 13, 2011, the contents of which is incorporated herein in its entirety.

FIELD OF THE INVENTION

The invention relates to a flexible pouch. More particularly the invention relates to a flexible pouch having indicia on the interior of the pouch body. Indicia is inscribed within the interior wall surface so as to be seen through the transparent first panel, and hide indicia printed on the back panel.

BACKGROUND OF THE INVENTION

Flexible pouches are formed from a sheet of material. The sheet may be supplied in a roll of pliable material, and cut into distinct panels. The sheet may be formed of multiple layers of different material. In some embodiments the pouches are formed from a first panel and a second panel. The first and second panels are cut so as to be symmetrical to each other and sealed along the edges so as to form the pouch body. An opening may be formed along a portion of the sealed edges so as to accommodate a fitment. Alternatively one of the panels may include a membrane portion operable to be pierced so as to allow a device such as a straw to access the contents of the pouch body.

It is known to print indicia on the outer surfaces of the front and back panels of the pouch. The indicia may include information such as the name brand of the product, dietary information of the product, and a barcode. It is also known to have flexible pouches with a transparent front panel. An advantage of such a pouch is that it allows the consumer to readily identify how much product remains within the pouch body.

In instances where a transparent front panel is used, the indicia on the back panel, labeled simply "Indicia Bp" blends visually with the indicia, labeled "Spring Rocks", on the transparent front panel and thus may be confusing to the consumer, as seen in FIG. 1. Accordingly it remains desirable to have a flexible pouch having a transparent front panel with indicia and a back panel with indicia that is visual from the front panel and hides the indicia on the back panel from view of the front panel so as to not confuse the consumer.

SUMMARY OF THE INVENTION

The present invention relates to a flexible pouch having a front panel and a back panel. The front and back panels are sealed together along the edges so as to form a pouch body. A portion of the sealed edges may be left open so as to provide a space for a fitment to be inserted therein. The front panel is transparent and may include indicia. The back panel has an outer surface having indicia which may be seen when viewed from the back of the pouch. The back panel may be formed by a plurality from view of layers of material. One of the layers of material includes indicia configured to obscure the indicia configured to be seen when viewing the outer surface of the back panel, view when viewing the front of the pouch. In other words, the inner wall of the pouch may include indicia such as a graphical image which serves an ornamental background for the indicia on the front panel of the pouch. The ornamental background is visible through the transparent front panel, and configured to obstruct the indicia on the back panel when viewing the front panel.

BRIEF DESCRIPTION OF THE DRAWINGS

Advantages of the present invention will be readily appreciated as the same becomes better understood by reference to the following detailed description when considered in connection with the accompanying drawings, wherein.

DETAILED DESCRIPTION OF THE INVENTION

Figure 1:
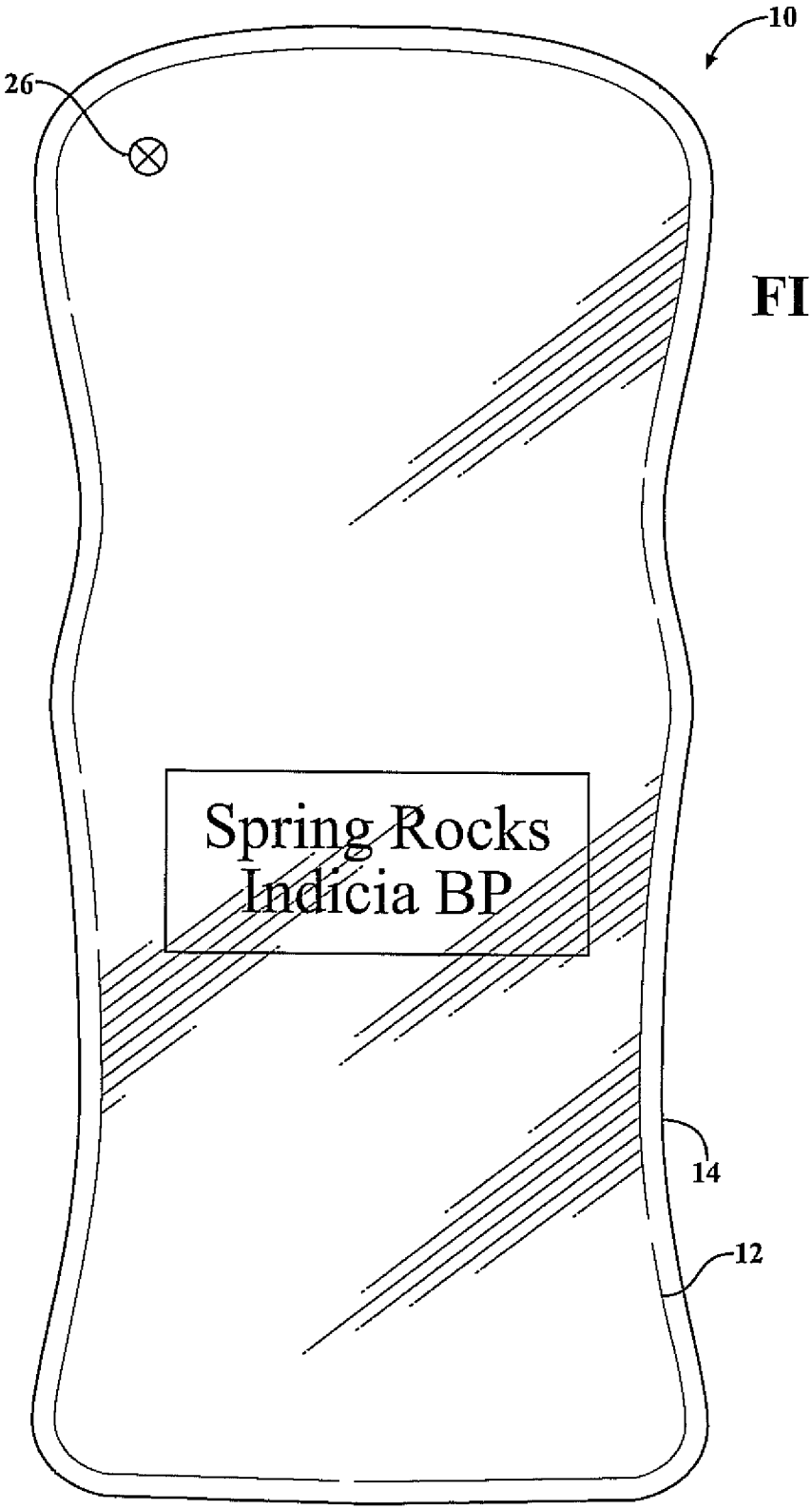
FIG. 1 is a perspective view of a prior art pouch body showing the front panel being transparent and the indicia of the back panel showing through the transparent front panel.

Referring to FIGS. 2-6, an illustration of a flexible pouch 10 of the present invention is provided. The pouch 10 has a first indicia 11*a*, such as a graphical image (shown as an environmental landscape) which serves an ornamental background for a second indicia 11*b* (shown as "SPRING ROCKS" and "SPRING WATER (473 mL))"configured to be viewed when looking at the face of a transparent front panel 12 of the pouch. Thus the first indicia 11*a* are visible through the transparent front panel 12. The back panel further includes a third indicia 11*c*, which is visible when viewing the back of the pouch. The first indicia 11*a* is configured to shield the third indicia 11*c* (shown as a man, a bar code, a block for nutritional facts, and "SPRING ROCKS" from view when viewing the pouch from the front.

The flexible pouch 10 may be formed from a sheet of pliable material, such as preprinted material of extruded or laminate layers. The material is typically a three, or four, or five or more gauge material, or two laminations of material or the like.

The choice of material is non-limiting, and includes material which may melt when exposed to a predetermined temperature. One example of a laminate material structure includes at least one layer of virgin polyethylene terphalate (PET), at least one layer of aluminum foil and another layer such as EVOH, PET, polyethylene or nylon or the like. Another type of laminate material structure may also include a metalized foil paper layer laminated to a cast polypropylene layer and another layer of PET, polyethylene or EVOH. There may be a fourth layer of nylon. Similarly, the laminate structure may include a cast polypropylene (CPP) layer, a polyethylene (PET) layer, a foil (AL) layer, a nylon (ONO) layer and another CPP layer. Another structure is the use of nylon, foil, nylon and cast polypropylene (ONO/AL/ONO/CPP) or CPP/NY/AL/CPP. Another example of a material structure is ONO/AL/COEX-ONO-LDPE. Still another is PET/AL/NYLON/CPP. The use of cast polypropylene laminate material also assists in retaining the filled shape of the container, even as the product is removed from the pouch 10. A further example of a laminate material structure is CPP/AL/ONO/PE.

The sheet of pliable material may be cut into distinct panels generally symmetrical to each other so as to form a front panel 12 and a back panel 14. Alternatively, the pouch may be formed from multiple sheets of material, which each sheet forming a front or back panel of the pouch body. Either a front or a back panel 12, 14 may be formed from multiple sheets of material. Some of the sheets of material may include preprinted indicia, while others may be transparent.

The sheet, or sheets as the case may be, may be cut into front and back panels 12, 14. The edges of the front and back panels 12, 14 are aligned, and sealed along the aligned edges 18 so as to form the pouch 10 having a front panel 12 and a back panel 14. Other features, (not shown) such as a gusset may be formed on the bottom portion of the pouch so support the pouch in an upright position.

The front and back panels 12, 14 may include a plurality of layers 16 of material. The front and back panel 12, 14 have respective side edges 18 and are sealed together along the side edges 18 so as to form a pouch body 20. The front and back panels 12, 14 further include respective outer surfaces 22*a* and 22*b* and inner surfaces 24*a* and 24*b*. The inner surfaces 24*a* and 24*b* of respective front and back panels 12, 14 are operable to be displaced from each other during filling operations so as to define a space for storing product.

The front panel 12 is generally transparent and may include indicia describing the brand name of the product, and graphical art work for aesthetic purposes. The back panel 14 also includes indicia. More specifically, at least two of the layers 16 of the back panel 14 include indicia. The one of the layers 16 having indicia is operable to hide the other layers 16 having indicia from view when the pouch is viewed from the front panel 12. The other of the layers 16 having indicia is displayed and visible when viewing the back panel 14 of the pouch body 20.

Figure 2:
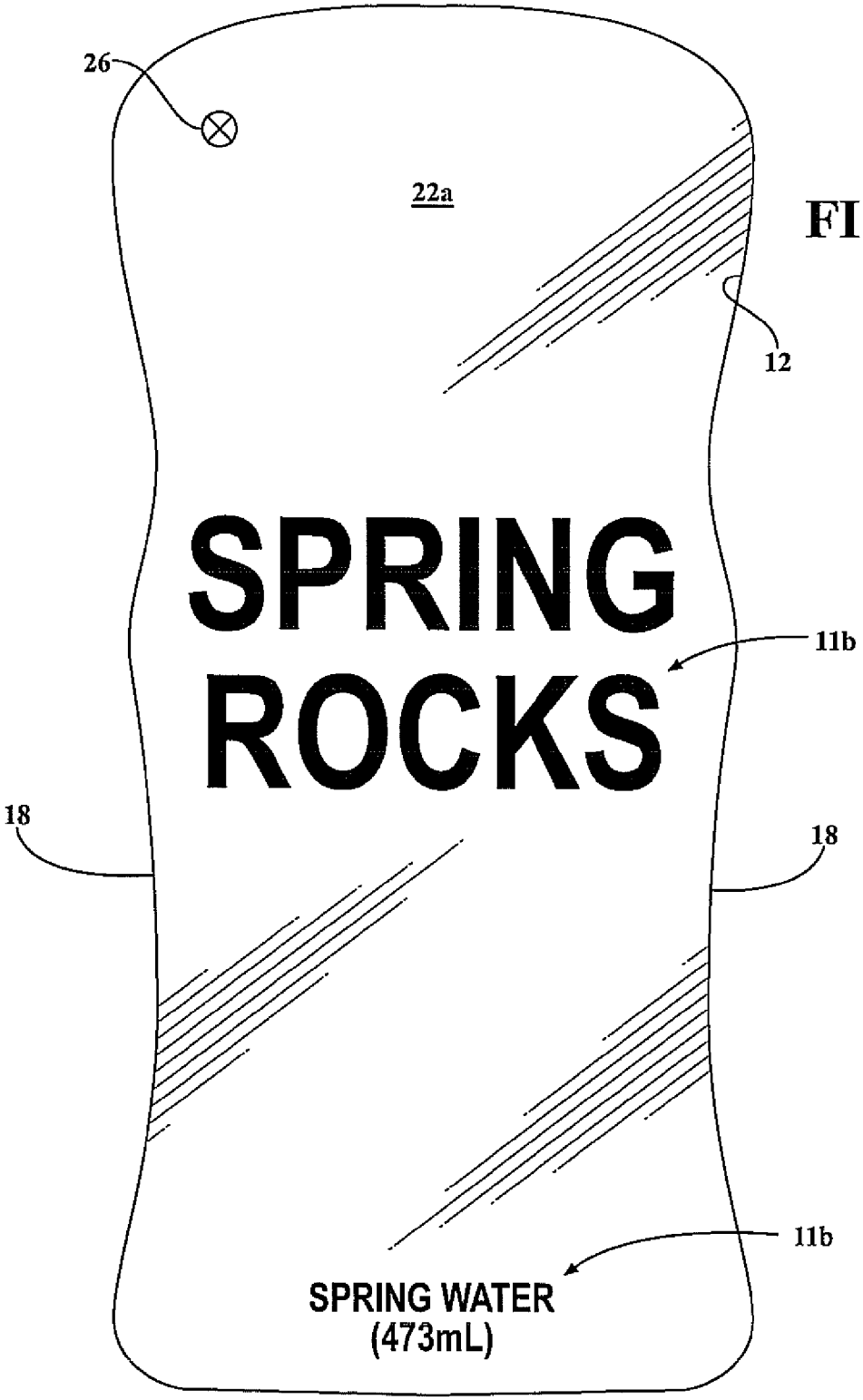
FIG. 2 is a perspective view of the front panel.
Figure 3:
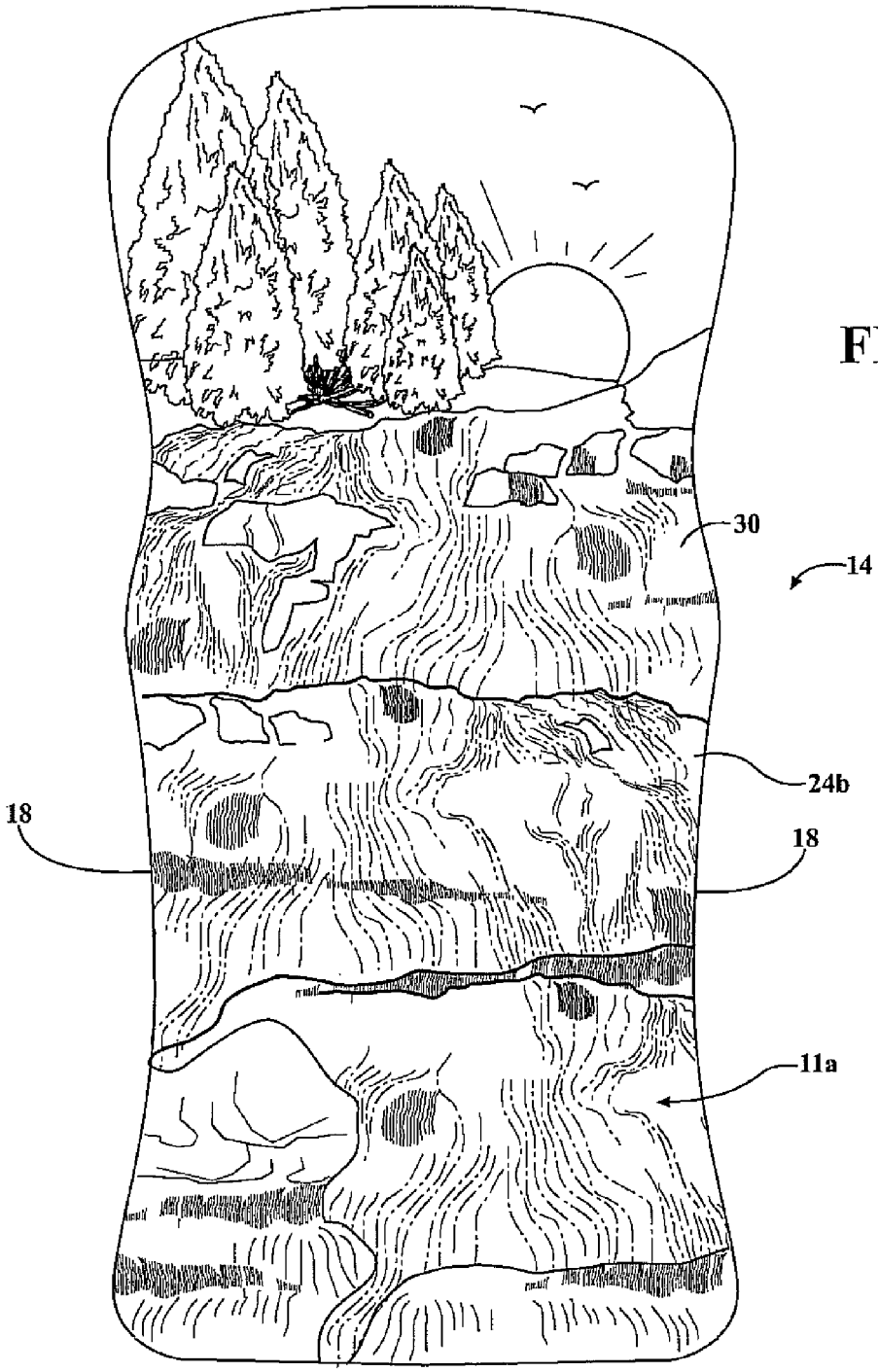
FIG. 3 is a perspective view of the inner surface of the back panel.
Figure 4:
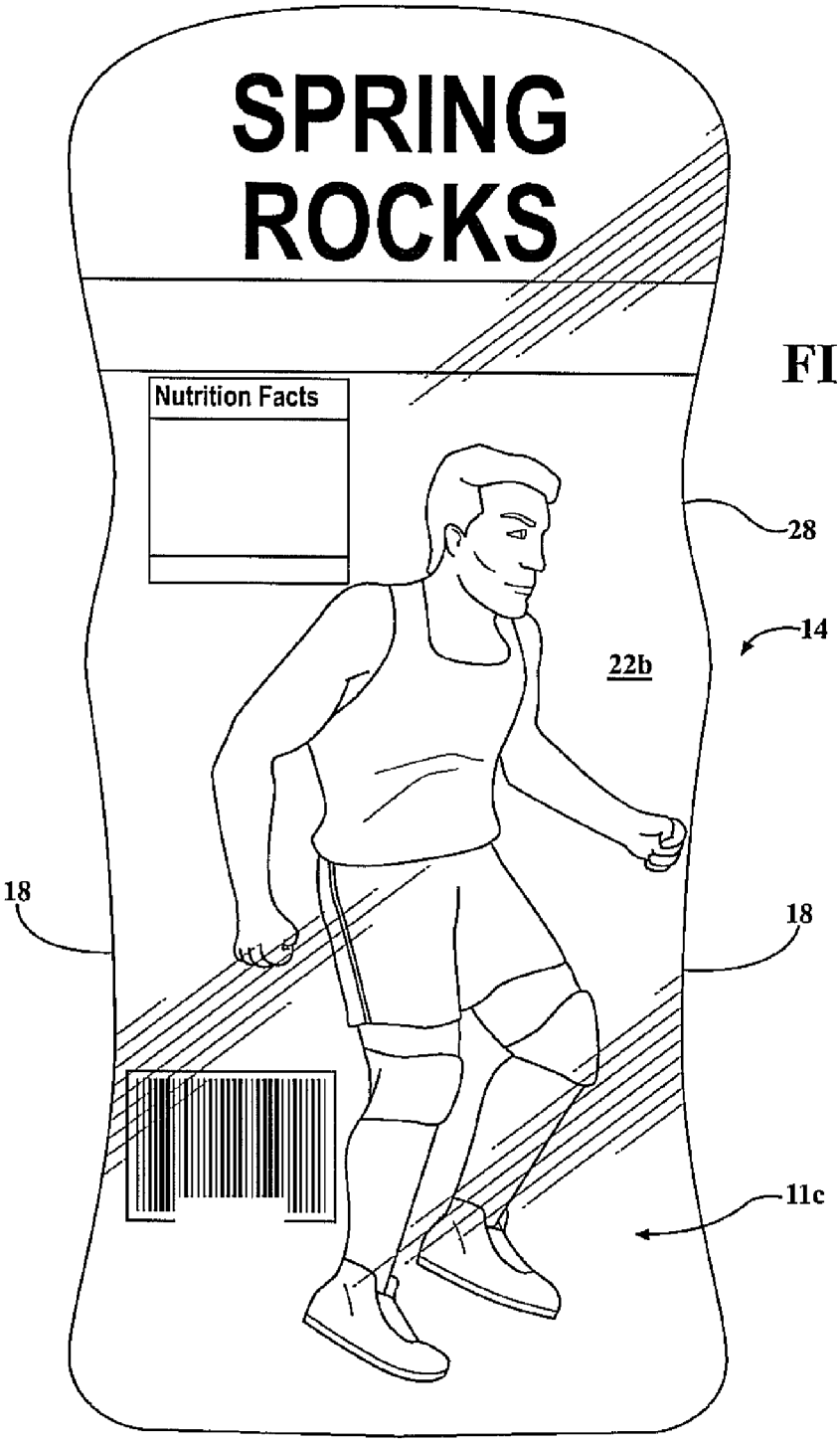
FIG. 4 is a perspective view of the outer surface of the back panel.

With reference now to FIGS. 2-4, the front and back panels 12, 14 are cut to form symmetrical shapes. FIG. 2 shows the outer surface 22*b* of the front panel 12 and the second indicia 11*b*. FIG. 3 shows the inner surface 24*b* of the back panel 14 and the first indicia 11*a*. FIG. 4 is the back side of FIG. 3, showing the outer surface 22*b* of the back panel 14 and the third indicia 11*c*. The edges 18 of respective front and back panels 12, 14 are sealed together so as to form a pouch body 20, as shown. An opening (not shown) may be left along a portion of the sealed edges 18. A fitment (not shown) may be mounted onto the opening so as to provide access to the contents of the pouch 10. Alternatively, one of either the front or back panel 12, 14 may include a membrane 26. The membrane 26 is pierceable so as to provide access to the contents of the pouch 10 using a device such as a straw. The outer edges of the pouch 10 may be curved so as to accommodate the grip and use of the pouch 10 by a single hand.

In a preferred embodiment the flexible pouch 10 is formed from a first roll of flexible preprinted laminate material forming a front panel 12, a second roll of flexible laminate material forming the outer surface of the back panel 14, and a third roll of flexible laminate material forming the inner surface of the back panel 14. The front and back panels 12, 14 are typically three to five gauge material. Both the front and back panels 12, 14 include a plurality of layers 16. One of the layers 16 is an outer layer 28 forming outer surfaces 22*a* and 22*b* of respective front and back panels 12, 14. Another layer 16 is the inner layer 30 forming the inner wall surface of the pouch body 20. Multiple layers 16 may be included between the inner and outer layers 30, 28.

Figure 6:
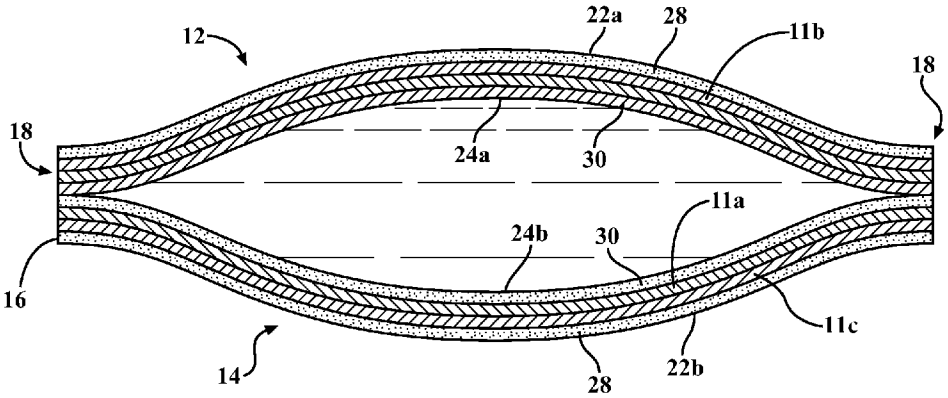
FIG. 6 is a cross-sectional view of FIG. 5 taken along line 6-6.

With reference now to FIG. 6, a cross-sectional view of a pouch of the present invention is provided. The layers 16 may be made of material such as virgin polyethylene terephthalate (PET), aluminum foil, EVOH, polyethylene, nylon, metalized foil paper laminated to a cast polypropylene layer, or the like. The inner layer 30 of the front and back panel 12, 14 is formed from a material operable to prevent ketones from being introduced with the product. Such a material is currently known and used and illustratively includes, PET, cast polypropylene (CPP), and the like.

The layers 16 forming the front panel 12 are transparent and may include the second indicia 11*b*. For illustrative purposes, the second indicia 11*b* is printed on the layer 16 behind the top layer. The first indicia 11*a* is shown printed on the layer 16 behind the inner surface 24*b*, as viewed from the front of the pouch. The third indicia 11*c* is printed on the layer 16 in front of the layer forming the outer surface 22*b* as viewed from the front of the pouch 10.

With reference again to FIG. 4, an illustrative view of the outer surface 22*b* of the back panel 14 is provided. The indicia are on one of the layers 16 of the back panel 14 and visible when viewing the back of the pouch 10. In one embodiment, the outer layer 28 of the back panel 14 includes preprinted indicia. However, it should be appreciated that, the outer layer 28 of the back panel 14 may be clear and one of the layers 16 between the outer layer 28 and the inner layer 30 is printed with indicia and displayed through the clear outer layer 28 as shown in FIG. 6. The indicia provide information such as dietary nutritional facts, brand markings, barcodes, contact information, images, and the like.

With reference again to FIG. 2, an illustrative view of the front panel 12 of the pouch is provided. The front panel 12 is generally transparent. In one embodiment, the outer layer 28 of the front panel 12 includes the second indicia which may be indicia such as brand names, volume content, distribution information, and the like. The second indicia is visible from the front of the pouch 10. Alternatively, the outer layer 28 of the front panel 12 is clear and one of the layers 16 forming the front panel 12 is printed with indicia so as to be visible from the front of the pouch 10.

Figure 5:
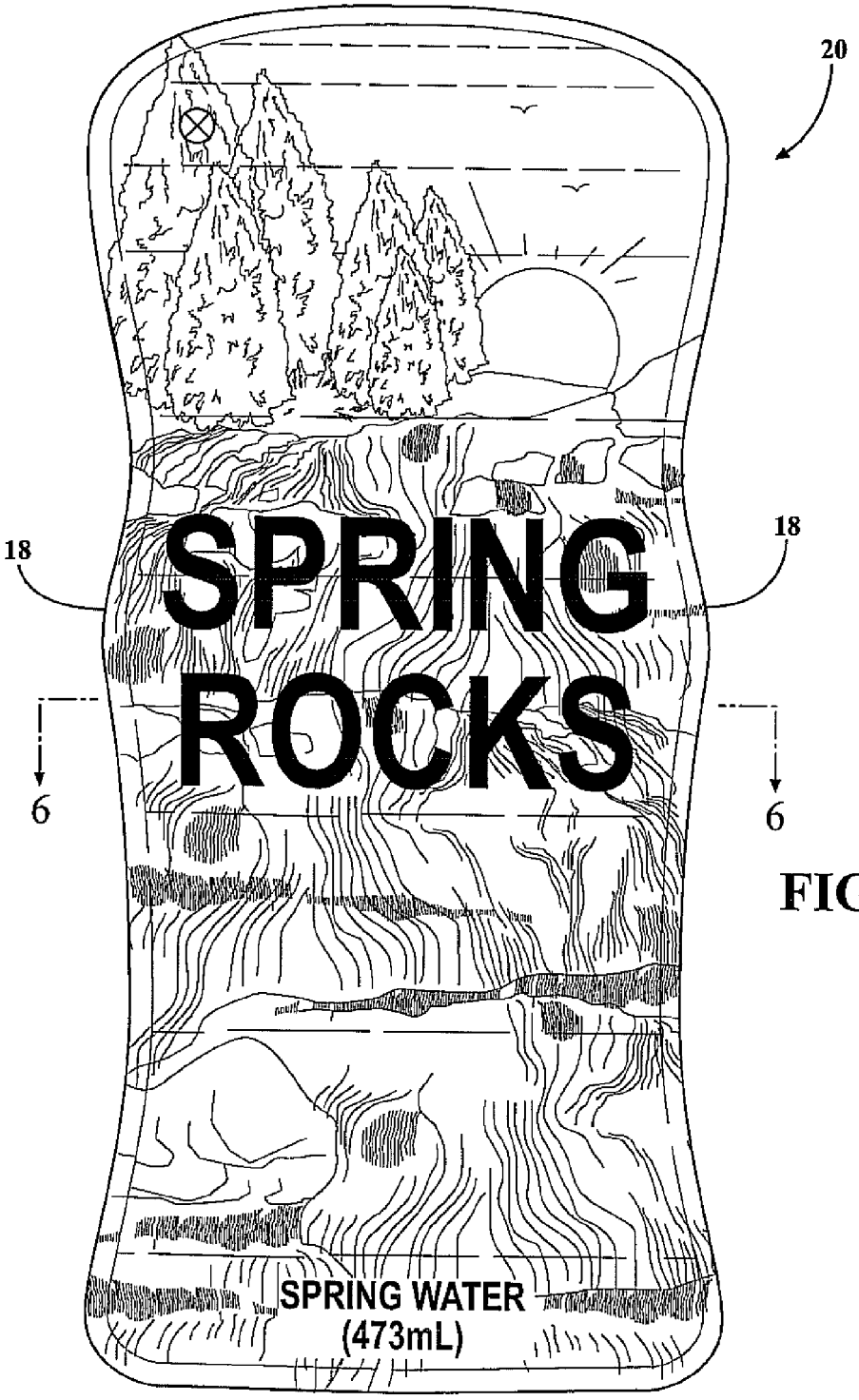
FIG. 5 is a perspective view of the pouch assembled taken from the front of the pouch.

With reference now to FIG. 3, an illustrative view of the inner surface 24*b* of the back panel 14 is provided. The first indicia is visibly displayed on the inner surface 24*b* of the back panel 14. One of the layers 16 between the inner layer 30 and outer layer 28 of the back panel 14 may be printed with the first indicia such as a graphic image. The layer 16 may be formed of an opaque material so as to further block the third indicia from view when the pouch is viewed from the front. The graphic image fills the entire surface of the layer 16 and hides from view the third indicia on the outer layer 28 of the back panel 14. Accordingly when viewed from the front the flexible pouch 10 of the present invention, the first indicia visible on the inner surface 24*b* of the back panel 14 provides a background image for second indicia displayed on the front panel 12 of the pouch. With reference now to FIG. 5, an illustrative example of the operation of the assembled pouch 10 is provided. The layer 16 of the back panel 14 showing the first indicia 11*a* is visible from the interior of the pouch 10.

Figure 7:
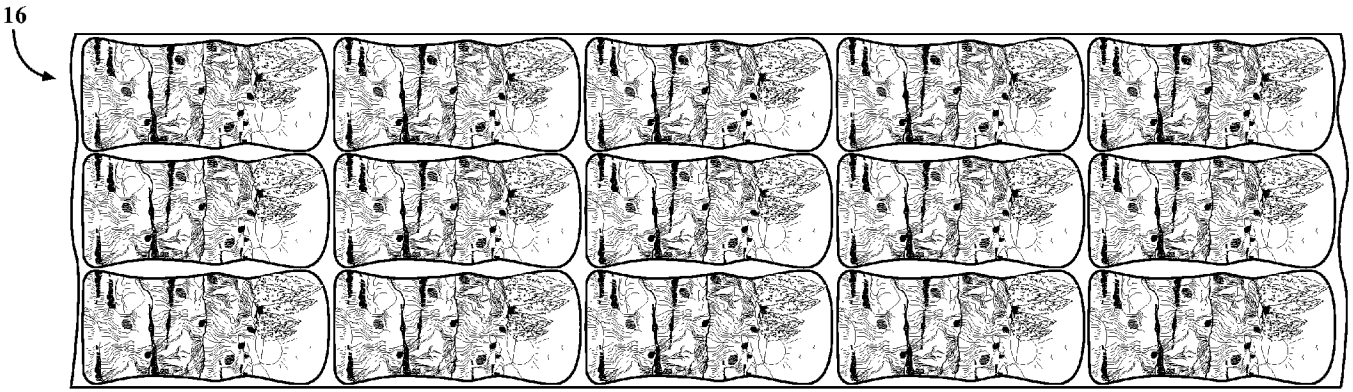
FIG. 7 is a perspective view of a layer of the back panel visible from the interior of the pouch is provided.

Preferably the back panel of material is formed so that one of the layers 16 of material is preprinted with indicia such as a graphical image that is repeated continuously along the surface of the layer 16 as shown in FIG. 7. More specifically, each graphical image is printed so as to be contiguous with the other. Therefore, the entire layer is filled with repetitions of a graphical image. Having a layer 16 of material made is such a manner eliminates the need for aligning the graphical image visible on the interior surface of the pouch body 20 with the indicia visible from the back of the pouch 10.

The background image as explained above is formed on one of the layers 16 of the back panel 14 and is visible through the transparent front panel 12 of the pouch. Furthermore, the back ground image hides the indicia printed on the other layer 16 of the back panel 14. Thus the present invention provides a flexible pouch 10 that prevents indicia visible from the front panel 12 from blending with indicia visible from the back panel 14 thus adding aesthetic value to the pouch and assisting users with discerning and reading information from respective front and back panels 12, 14.

Figure 8:
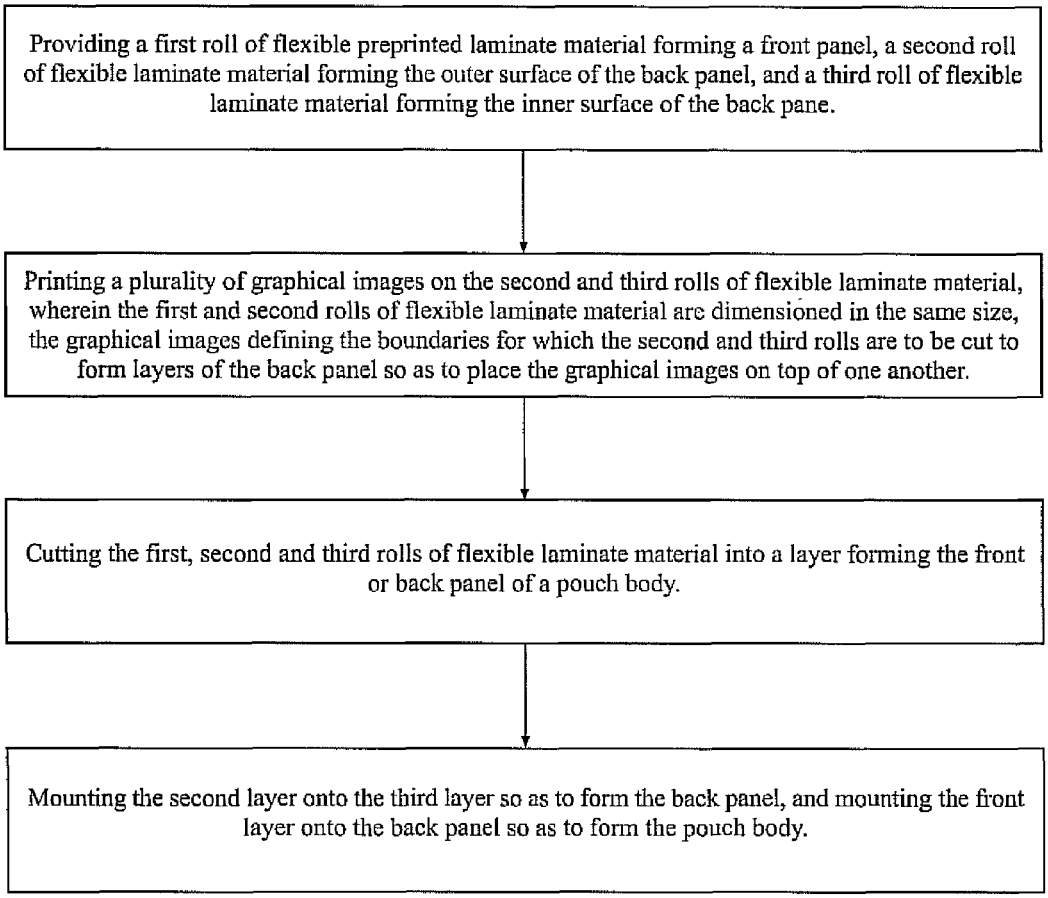
FIG. 8 is a diagram showing the steps for a method of manufacturing a pouch.

With reference now to FIG. 8, a method of manufacturing a pouch is also provided. The method includes the steps of providing a first roll of flexible preprinted laminate material forming a front panel 12, a second roll of flexible laminate material forming the outer surface of the back panel 14, and a third roll of flexible laminate material forming the inner surface of the back panel 14.

The method proceeds to the step of cutting the first, second and third rolls of flexible laminate material into a layer forming the front or back panel of a pouch body. The method proceeds to the step of mounting the second layer onto the third layer so as to form the back panel, and mounting the front layer onto the back panel so as to form the pouch body.

The front and back panels 12, 14 are typically three to five gauge material. Both the front and back panels 12, 14 include a plurality of layers 16. One of the layers 16 is an outer layer 28 forming outer surfaces 22*a* and 22*b* of respective front and back panels 12, 14. Another layer 16 is the inner layer 30 forming the inner wall surface of the pouch body 20. Multiple layers 16 may be included between the inner and outer layers 30, 28.

Preferably the second and third rolls of laminate material is preprinted with indicia such as a graphical image that is repeated continuously along the surface of the layer 16. More specifically, each graphical image is printed so as to be contiguous with the other. Therefore, the entire layer is filled with repetitions of a graphical image. Having a layer 16 of material made in such a manner eliminates the need for aligning the graphical image visible on the interior surface of the pouch body 20 with the indicia visible from the back of the pouch 10

The invention has been described in an illustrative manner. It is therefore to be understood that the terminology used is intended to be in the nature of words of description rather than limitation. Many modifications and variations of the invention are possible in light of the above teachings without varying from the scope and spirit of the invention described herein.

The invention claimed is:

1. A pouch for holding fluids, the pouch comprising:

a pouch body having a front panel and a back panel each having a peripheral edge, the front and back panel symmetrical to each other, the peripheral edge of the front panel and the back panel are sealed together, the front and the back panel each having multiple layers of material, each of the multiple layers of the front panel is entirely formed of a transparent material and one of the multiple layers of the front panel includes a second indicia visible from the front of the pouch; and wherein one of the layers of the back panel is an inner layer, the inner layer forming an inner surface of the pouch body and is entirely opaque, a first indicia is disposed on the entire inner layer so as to be seen from the front of the pouch, the first indicia covering the entire inner layer, and one of the layers of the back panel is an outer layer defining an outer surface of back panel, the outer layer being opaque and having a third indicia seen from the back panel and is spaced apart from the inner layer, the second indicia and first indicia being seen from the front panel, the first indicia configured to block out the third indicia when the pouch is viewed from the front.

2. The pouch as set forth in claim 1, wherein the layers are formed of laminate material.

3. The pouch as set forth in claim 1, further including a membrane disposed on the front panel, the membrane configured to be pierced with a straw so as to provide access to the contents of the pouch body.

4. The pouch as set forth in claim 1, wherein the outer edges of the pouch are curved so as to accommodate the grip of a user.

5. The pouch as set forth in claim 1, wherein the front panel further includes an inner layer, the respective inner layers of the front and back panel forming an inner space of the pouch body, the respective inner layers of the front and back panel formed of a material operable to prevent ketones from entering the inner space.

6. The pouch as set forth in claim 5, wherein the inner layers of the front and back panel is formed of one material selected from the group consisting of virgin polyethylene terephthalate, and cast polypropylene.

* * * * *